US009598148B2

(12) United States Patent
Volkwein

(10) Patent No.: US 9,598,148 B2
(45) Date of Patent: Mar. 21, 2017

(54) CAM CLEAT

(71) Applicant: Fred Volkwein, West Palm Beach, FL (US)

(72) Inventor: Fred Volkwein, West Palm Beach, FL (US)

( * ) Notice: Subject to any disclaimer, the term of this patent is extended or adjusted under 35 U.S.C. 154(b) by 93 days.

(21) Appl. No.: 14/456,695

(22) Filed: Aug. 11, 2014

(65) Prior Publication Data

US 2015/0040814 A1 Feb. 12, 2015

Related U.S. Application Data

(60) Provisional application No. 61/864,968, filed on Aug. 12, 2013, provisional application No. 61/944,268, filed on Feb. 25, 2014.

(51) Int. Cl.
*B63B 21/08* (2006.01)

(52) U.S. Cl.
CPC ..... *B63B 21/08* (2013.01)

(58) Field of Classification Search
CPC A43C 7/08; B63B 21/08; B63B 21/00; F16G 11/10; F16G 11/106; F16G 11/00; Y10T 24/3951; Y10T 24/3944; Y10T 24/394
USPC ..... 114/218
See application file for complete search history.

(56) References Cited

U.S. PATENT DOCUMENTS 2,627,834 A * 2/1953 Roberts ..... B63B 21/08 114/199
3,650,236 A 3/1972 McFarlane
3,750,611 A 8/1973 Field
3,765,061 A * 10/1973 Nash ..... A43C 3/04 114/210
3,795,218 A 3/1974 Merry
D248,367 S 7/1978 Haft
4,453,486 A 6/1984 Harken
4,620,499 A 11/1986 Slemmons
4,895,094 A 1/1990 Carlstedt
4,956,897 A 9/1990 Speedie
4,998,495 A 3/1991 Bos et al.
5,327,847 A 7/1994 Cook
D357,404 S 4/1995 Doyle
5,596,791 A 1/1997 Parsons
5,660,133 A 8/1997 Munich
5,987,711 A 11/1999 Parsons
6,094,783 A 8/2000 Parsons
(Continued)

*Primary Examiner* — Jack W Lavinder
(74) *Attorney, Agent, or Firm* — McHale & Slavin, P.A.

(57) ABSTRACT

The instant invention is a cam cleat assembly that includes a base member, two removably mounted spindle pins and two rotationally mounted cam members having teeth for gripping rope, sails, twine cord or the like. The base plate includes a smooth transitioning ramp surface that allows for increased angular interaction with a rope or line member. The base plate also includes a pair of pockets sized to cooperate with the removable spindles for alignment and a more secure placement under heavy loads to minimize deflection of the spindles and thus the cam members. Removable and replaceable spindle pins are provided to allow easy replacement for extended life of the device. Seals are provided around the fasteners to allow quick and accurate reassembly while maintaining a watertight assembly to prevent the ingress of salt and/or water into the assembly from the mounting surface.

9 Claims, 4 Drawing Sheets

(56) References Cited

U.S. PATENT DOCUMENTS

| | | | | |
|---|---|---|---|---|
| 6,178,604 | B1 * | 1/2001 | Pennoyer, Jr. ..... | D06F 53/005<br>24/134 |
| 6,604,482 | B1 | 8/2003 | Martello | |
| D481,002 | S | 10/2003 | Sherman et al. | |
| 7,143,708 | B1 | 12/2006 | Cimino | |
| D557,652 | S | 12/2007 | Gassew | |

* cited by examiner

CAM CLEAT

RELATED APPLICATIONS

In accordance with 37 C.F.R 1.76, a claim of priority is included in an Application Data Sheet filed concurrently herewith. Accordingly, the present invention claims priority to U.S. Provisional Patent Application No. 61/864,968, filed Aug. 12, 2013, entitled "CAM CLEAT" and U.S. Provisional Patent Application No. 61/944,268, filed Feb. 25, 2014, entitled, "CAM CLEAT". The contents of the above referenced application are herein incorporated by reference in their entirety.

FIELD OF THE INVENTION

This invention relates to the field of boating, and more particularly, to a cam cleat with a reduced profile to reduce line abrasion.

BACKGROUND OF THE INVENTION

Pleasure boats come in all shapes and sizes. Common to all boats is the need to dock the boat for loading/unloading, mooring, rafting-up and so forth. For this reason, boats commonly employ the use of fenders positioned between the boat hull and a dock to prevent damage to the boat. A fender is typically constructed of rubber, vinyl, foam elastomer, or plastic designed to absorb the kinetic energy released when a boat attempts to impact the dock to prevent damage to either structure. Air filled fenders are the most practical type of fender, providing a lightweight, soft sided fending device that employs air to provide a cushioned effect.

Conventional boats, from small fishing boats to large yachts, are commonly constructed from fiberglass, aluminum or steel, which is easily damaged if impacted with an unprotected dock. The use of a fender between the rigid dock and the movable boat is complicated by the fact that a boat can be of most any shape, and that the boat is subject to winds and tidal changes. Adding to this complexity is the potential for quick vertical movements caused by waves, whether wind driven or man made from a passing vessel, which presents a volatile mix of water movements that make strategic fender adjustment a necessity if the boat is to be protected. If it is difficult to properly position a fender, even the best fender becomes useless. Further, as the size of a boat increases so does the necessity of larger fenders, which make it even more difficult to strategically position.

The mounting of a fender is typically facilitated by use of a line attached to one or both ends of the fender. The fender can then be placed in a vertical position by securing one line, or a horizontal position when the line from each end is captured. Each end of the line is secured to the boat, allowing the fender to drape over the side for positioning between the hull and object, such as a dock piling. Conventionally, the boat operator will tie one end of the line to a cleat or railing and adjust from that position. Unfortunately, tying of a line to a railing is not as simplistic as it implies, as there are a number of factors that can complicate it, including: the weight of the fender, the inability to tie a proper knot, the hesitancy to change a fender location that is just slightly off due to the hassle of attempting to reposition the fender, lack of proper railing or cleat at the desired location, and so forth.

For the above reasons, a number of devices have been employed that allow for hooking a fender directly to the side of the vessel in an effort to permit ease of adjustment. Such devices may include mechanisms that allow the fender line to be easily adjusted. The following U.S. Patents are illustrative of known fender line clamps: U.S. Pat. Nos. 3,650,236; 3,750,611; 3,795,218; 4,453,486; 4,620,499; 4,895,094; 4,956,897; 4,998,495; 5,327,847; 5,596,791; 5,660,133; 5,987,711; 6,094,783; 6,604,482; 7,143,708; D248,367; D357,404; D481,002 and D557,652. Most known devices require that the fender line be fed through an aperture, thereby limiting the size of the line to fit a particular adjuster, or the line must be attached to a railing.

Cam cleats are devices typically used on sailboats that provide ease of line positioning for adjustment of the sails. Cam cleats include numerous variations, all of which are designed to capture the line between two rotatable cam-shaped members. For instance, U.S. Pat. No. 3,750,611 discloses a pair of threadably engaged pivotable cam members having oppositely directed surfaces that are pivotably mounted on a base. The cam members are spring biased, and in the '611 disclosure, permitted to rotate in either direction against the bias of a spring.

Typical cam cleats include protruding screw heads and protruding cap nuts in close proximity to where the line enters the cam cleats, resulting not only in busted knuckles, but interference of a desirable smooth contour for placement of lines into the cam cleats. Lock nuts found in the prior art require a certain number of threads protrude above the nut to insure full engagement of any locking members, exposing lines and skin to snagging and cutting on sharp protruding threads.

Previous cam cleats utilized an external machine screw and a nut to hold all of the parts as one assemblage, or, additionally utilized a tight slip fit on the main axle for securing the assemblage. Those previous cam cleats are difficult to reassemble once taken apart.

Prior art cams for cam cleats are typically manufactured by the process of sand casting. Thus, negative models of the cam are required to be made, increasing the cost of entering the market. Manufacturing requires the negative models to be used for preparation of the sand molds before molten stainless steel can be poured into the mold. The cams are then cooled before the sand is broken away to free the rough cam members. Substantial machining and finishing processes are then required to create the final monolithic cam. This process is expensive, requires long lead times and scores of skilled workers to complete the numerous processes.

U.S. Pat. No. 3,795,218 discloses the spring operated cam cleat assembly for use on a sailboat. In this assembly the cams are constructed of multiple pieces. The main portion of each cam is hollowed out for insertion of a top portion of the cam, which extends downwardly through the center portion of the main cam portion. A top loop member extends over the top and between the two cams, requiring a user to thread the rope through the loop prior to engagement with the cams. In addition, bolt heads protrude above the cams, leaving sharp surfaces in close proximity to the rope and knuckles.

U.S. Pat. No. 4,453,486 discloses a cam cleat assembly that includes three rows of free ball bearings to provide for movement of the cams under load. Unfortunately, this assembly is virtually impossible to take apart and repair or rebuild due to the inability to control the free balls for reassembly.

U.S. Pat. No. 4,620,499 discloses a cam cleat assembly having an elongated handle secured to one of the cams. The elongated handle can be used for manual operation of the cam, or the free end of the line can be used to open the cam.

Unfortunately, the free end of the line may inadvertently open the cam, releasing the rope in an unwanted situation.

U.S. Pat. No. 4,956,897 discloses the cam cleat assembly wherein each cam member includes two gripping surfaces arranged in a symmetrical relation to eliminate the need for a left and a right cam member.

What is lacking in the art is a cam cleat assembly that includes a low profile construction devoid of sharp edges or protruding fasteners that can cut lines or hands. The cam cleat assembly should also include single piece bearings within each cam member, the bearings constructed and arranged to minimize surface engagement between the cam members and the support structure to prevent galling and reduce force required for operation of the cams. The cam cleat assembly should also include removable and replaceable spindle members, which the cam members rotate around. The spindle members should include a seal member that prevents the ingress of water and salt into the bearing area from underneath of the base plate member.

SUMMARY OF THE INVENTION

The instant invention is a cam cleat assembly that includes a base member, two removably mounted spindle pins and two rotationally mounted cam members having teeth for gripping rope, line, twine cord or the like. The base plate includes a smooth transitioning ramp surface that allows for increased angular interaction with a rope or line member. The base plate also includes a pair of pockets sized to cooperate with the removable spindles for alignment and a more secure placement under heavy loads to minimize deflection of the spindles and thus the cam members. Removable and replaceable spindle pins are provided to allow easy replacement for extended life of the device. Seals are provided around the fasteners to allow quick and accurate reassembly while maintaining a watertight assembly to prevent the ingress of salt and/or water into the assembly from the mounting surface. One-piece bearings are provided which cooperate with the spindles to accept high loads without deformation. The one-piece bearings are also constructed to include flanges which function as thrust bearings to minimize contact between the cam members and the mounting plate for reduced friction and galling due to rubbing against the base plate under load. Flush mount top nuts cooperate with the spindles so that the top nuts are substantially flush with the top surface of the cam members to provide a low profile and prevent ropes or knuckles from catching on the fasteners during use. Unless care is exercised in manufacturing a machine screw, small burrs may develop that will snag the line or tear the skin. The base plate may be secured to the fender hook assembly or alternatively, to any portion of a boat, including power boats, sail boats, large ships and the like, where it is desired to quickly attach, adjust and release lines or ropes.

In a preferred embodiment, the cams are manufactured by a unique method. The method includes wire electric discharge machining (wire EDM) of plate material to substantially finished dimensions. The plates are secured together in a vertical arrangement and minimal finishing operations are performed to complete the cam member for operation, thereby eliminating the need for the traditional casting technique. Other methods suitable for production of a cam member are water jet cutting and laser cutting which would provide similar plates that could be arranged in the stack and secured together.

When utilized on a fender hook, the cam cleat assembly may be secured to a rigid "L" or "U"-shaped attachment bracket, commonly referred to as a fender hook, having an inner surface lined with a non-marring material such as lamb's wool. Mounted to the outer surface is a cam cleat assembly and one or two alignment guides. The fender hook assembly allows placement over a gunnel or railing of a marine vessel without marring. In operation, a line from a marine fender is placed through the guides and, as the line is pulled, it is directed so that the line cooperates with the cams, causing them to open to accept the rope or line. As the pulling pressure is released, the cams rotate so that the lobes of the cams come in closer proximity to each other, thereby engaging the line or rope to prevent further line or rope from being extended. Additional pulling pressure from the marine fender side results in the cams being further rotated toward each other, thereby gripping the rope or line tighter to prevent slippage.

An objective of the present invention is to provide a low cost, high quality cam cleat for use in boat line securement.

Another objective of the present invention is to teach the use of a cam cleat having a non-metallic bearing that includes integral flanges that reduce friction and wear in the assembly.

Still another objective of the present invention is to provide a cam cleat that is constructed and arranged for easy disassembly and reassembly for rebuilding or repair.

Yet another objective of the present invention is to teach a cam cleat assembly having a base plate with pockets for locating and stabilizing a pair of removable spindles.

Still yet another objective of the present invention is to provide a cam cleat assembly having removable and replaceable spindle members.

Still yet another objective of the present invention is to provide a cam cleat assembly that utilizes seals on the assembly fasteners to reduce the ingress of water, dirt and debris into the assembly, whereby the seal acts as a lock washer to prevent loosening of the machine screw caused by vibration.

Still yet another objective of the present invention is to disclose the use of a cam cleat suitable for use upon a fender hook in combination with guideline directional brackets so as to prevent inadvertent disengagement of the line from the cam cleat assembly.

Still another objective of the present invention is to disclose a cam cleat that is mounted from beneath, thereby concealing the mounting fasteners.

Still yet another objective of the present invention is to disclose a cam cleat formed with smooth surfaces to eliminate line snags by eliminating protruding screw heads and nuts.

Yet another objective of the present invention is to disclose a method of producing a cam for a cam cleat whereby the cam is formed by layers of material in a stacked arrangement.

Yet another objective of the present invention is to disclose a method of producing a cam for a cam cleat that utilizes electrical discharge machining to form layers of metal for use in manufacturing a cam for a cam cleat.

Yet another objective of the present invention is to disclose a method of producing a cam for a cam cleat that utilizes laser machining to form layers of metal for use in manufacturing a cam for a cam cleat.

Yet another objective of the present invention is to disclose a method of producing a cam for a cam cleat that utilizes water jet machining to form layers of metal for use in manufacturing a cam for a cam cleat.

Other objectives and further advantages and benefits associated with this invention will be apparent to those skilled in the art from the description, examples and claims, which follow.

DETAILED DESCRIPTION OF THE PREFERRED EMBODIMENT

Figure 1:
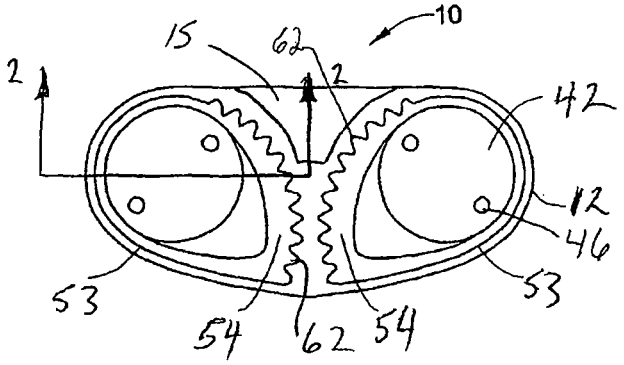
FIG. 1 is a top view of one embodiment of the cam cleat assembly of the present invention.

Referring to FIGS. 1-9, set forth is a cam cleat assembly 10 formed from a base plate 12, a pair of spindle members 14, a pair of cam members 40 and a pair of top nuts 26. The base plate 12 includes a smooth transitioning ramp surface 15 that allows for increased angular interaction with a rope or line member. The ramp surface starts at about the center of the top surface of the base plate, and extends substantially to the bottom edge of the front of the base plate. The base plate 12 also includes a pair of pockets 16 sized to cooperate with the removable spindles 14 for alignment and a more secure placement under heavy loads to minimize deflection of the spindles and thus the cam members. The pockets 16 extend partially through the base plate 12 and include a shape that mirrors the shape of the base portion of the spindle. A spindle bolt aperture 17 extends through each pocket 16 so that a fastener 60 may be extended upwardly through the base plate and into the spindle member. Seals 18 are provided around the fasteners 60 to allow quick and accurate reassembly while maintaining a watertight assembly to prevent the ingress of salt and/or water into the assembly from the mounting surface. In addition, the seal prevents loosening of the fastener from vibration. In a most preferred embodiment, the seals are o-rings, which may be constructed from any material or combination of materials known in the art. Also included on the base plate is a stop pin 20. The stop pin cooperates with spring member 22, as well as cam member 40, to bias the cam member to its base position as illustrated in FIG. 1. The pin also prevents over rotation of the cam members by engaging internal stop surfaces 74 and 75.

Still referring to the figures, the spindle members 14 include a top end 24 and a bottom end 28. When viewed from the top, the top end 24 is cylindrical in shape for cooperation with a bearing member 30, while the bottom end 28 is shaped to cooperate with the pockets 16 in the base plate 12. In a most preferred embodiment, the pocket and the bottom end of the spindle member are formed round for ease of manufacturing. However, it should be noted that the bottom end might take any suitable shape that can be formed as a pocket into the base plate. Keyed shapes and the like may prevent unwanted rotation of the spindle members under extreme loading. The bottom end of the spindle members 14 also includes an internal threaded bore 32, which cooperates with fastener 60 to retain the spindle members 14 in the pockets 16. The top end 24 of the spindle member 14 may include a threaded stem 34 or internal threaded bore 32 for cooperation with a top nut 36. In either embodiment, the top nut includes the conjugate threading surface for cooperation with the spindle 14. A central portion of the spindle member includes a flange 38, which cooperates with the bearing member 30, the spindle 14 and the top nut 36 to prevent the cam member 40 from moving vertically along the spindle member 14. In a most preferred embodiment, the cam member is suspended slightly above the top surface of the base plate to prevent friction between the two members during operation. This construction reduces the pressure required to operate the device, and allows for slight deflection of the pins without galling under heavy loading.

The top nut 36 includes an oversized head portion 42 and a stem portion 44. In one particular embodiment, the head portion 42 includes two holes or "snake eyes" 46 located in a spaced apart relationship for engagement with a twin pin driver. The snake eye construction reduces line abrasion and provides a reduction in surface protuberances, allowing the cam cleat assembly to have a low smooth profile. In an alternative embodiment, the head portion 42 may include an alternative internal driving mechanism such as, but not limited to, hex, torx or Phillips. In a most preferred embodiment, the head portion 42 fits into a counterbore 48 to lower the profile of the assembly and reduce edges and surfaces that may cut or chafe ropes or hands.

Still referring to the figures, the cam members 40 include an innerbore 52 and an outer cam surface 53 having a non-symmetrical lobe 54. The inner bore is sized to cooperate with a solid bearing member 30, and preferably includes a shoulder 56 for cooperation with bearing flange 58 to prevent the bearing from shifting with the cam member. Teeth 62 are provided on the outer surface 53 of the cam member 40 to engage the rope member. The teeth preferably extend about 90 degrees around the cam surface from the highest point of the cam lobe to the lowest surface of the cam member with respect to the spindle member. This construction provides for the most versatility with respect to the diameter of rope or cloth that can be effectively engaged. The cam bearing is preferably a one-piece bearing constructed from a non-metallic material such as DELRIN. The non-metallic material provides the most corrosion resistance while having sufficient rigidity to resist elastic deformation under load. Various other types of bearing materials can be substituted including acetron, ertalyte, turcite, ruton, or UHMW without departing from the scope of the present invention. The bearing 30 is generally round in shape having a central bore 72, a radial flange 58 and a lower flange 68. The central bore 72 is generally sized to cooperate with the top end 24 of the spindle member 14. Radial flange 58 cooperates with shoulder 56 within the cam member to prevent migration of the bearing member during loads. The radial flange also serves to prevent the cam member from moving downward toward the base plate under load. Lower flange 68 cooperates with the spindle flange 38 to maintain spacing between the cam member and the base plate to prevent friction and galling. The bearing top surface 70 cooperates with the head portion 42 of the top nut. In this manner, the cam member is provided with a bearing surface in any direction of loading.

In the preferred embodiment, the base plate 12, spindle members 14, and cam members 40 are constructed from highly polished stainless steel for corrosion resistance and superior bright work appearance. However, it should be noted that various materials could be substituted for the stainless steel without departing from the scope of the invention. Such materials may include, but should not be limited to, anodized aluminum, coated steel, plastics and the like.

In some embodiments, the cam cleat assembly 10 may be attached to a fender hook 80 without the need for unsightly top fasteners. In other embodiments, the cam cleat assembly 10 may be attached directly to boats, ships, sailboats and docks to name a few. In further embodiments, the cam cleat assembly 10 may be used in conjunction with flagpoles, tight rope walking, rock climbing, ski boots, bindings, and pulley systems.

Figure 4:
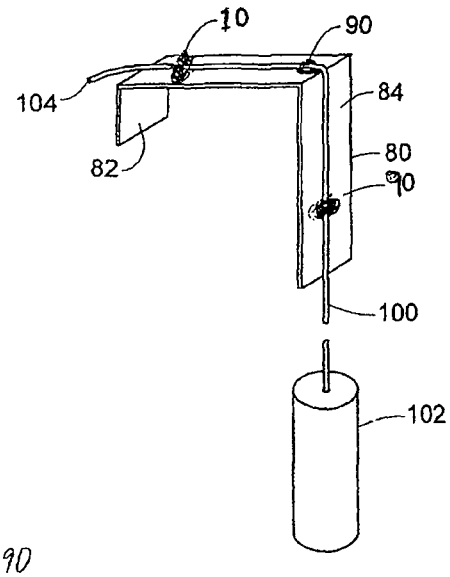
FIG. 4 is a perspective view of the instant invention with a fender line placed through the cam cleat and alignment guides.
Figure 5:
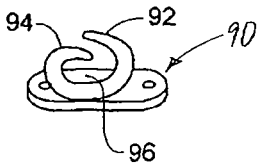
FIG. 5 is a perspective view of the alignment guide.
Figure 6:
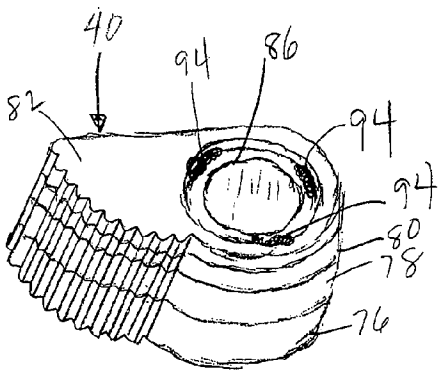
FIG. 6 is a top perspective of one embodiment of the cam member of the present invention.
Figure 7:
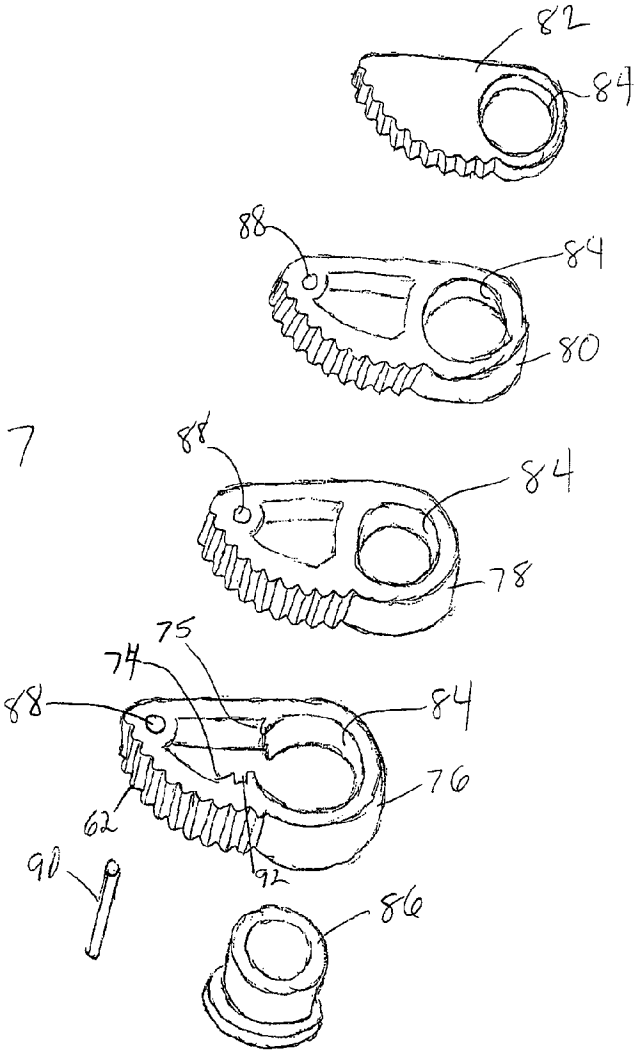
FIG. 7 is an exploded view illustrating the components of the cam member illustrated in FIG. 6.
Figure 9:
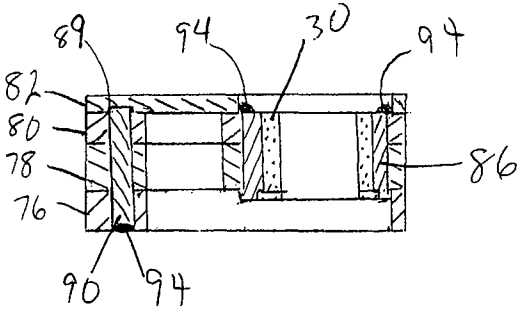
FIG. 9 is a section view taken along lines 9-9 of FIG. 8.
Figure 8:
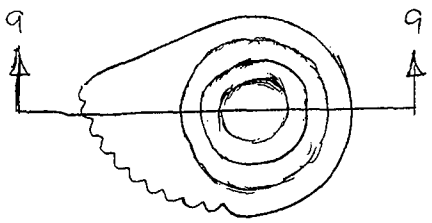
FIG. 8 is a top view of the embodiment of the cam member illustrated in FIG. 6.

Referring to FIGS. 4 and 5, the fender hook 80 has an inner surface 82, which is cushioned, preferably with a non-marring material such as foam rubber or, most preferably, lamb's wool. The fender hook is preferably rigid having an infrastructure formed of non-rusting stainless steel formed into a substantially "L" or "U"-shape configuration and encapsulated within a sleeve made of rubber, vinyl, leather or the like; the non-marring material adding a further layer of protection against marring. The fender hook 80 allows positioning over a gunnel of a boat. The cam cleat assembly 10 is positioned along the upper portion of the fender hook 80 for engaging of a fender line 100 and directional positioning of the fender 102. Alignment guides 90 are formed from a plate 96 having a substantially circular shaped ring welded to the plate with each end 92, 94 spaced apart for ease of line inserting. The alignment guides 90 are placed along a corner edge and a lower surface for maintaining the line 100 to prevent disengagement from the cam cleat assembly 10 and marring of the covering (leather, vinyl, etc.).

In operation, the fender hook 80 is placed over the gunnel of the boat in a position that is most appropriate for fending off the boat. The fender 102 is then placed alongside the boat hull with fender line 100 placed through the cam cleat. The line 100 is then drawn through the cam cleat until the fender is placed at its desired position. Once in position, line 100 is placed between the open ends 92, 94 of each alignment guide 90, maintaining the line 100 in a position so that the line cannot disengage from the cam members. Removal of the fender 102 simply requires the removal of the line 100 from each alignment guide 90 and outwardly from the top of the cam cleat assembly 10.

Referring to FIGS. 6-9, an alternative embodiment of the cam member is illustrated. In this embodiment, the cam member 40 is constructed from a stacked arrangement of relatively thin plates 76-82. The stacked arrangement of plates 76-82 is secured together in a manner to function and appear as a monolithic cam member 40 such as the one described above. Constructing the cam member from the stacked plates provides several advantages over the monolithic construction of the prior art by reducing cost of construction while producing a stronger final cam member. Prior art constructions typically utilize sand casting for the monolithic cams. The stacked construction allows the use of more modern manufacturing techniques such as laser cutting, water jet cutting and wire electrical discharge machining. These techniques provide components that are much closer to the finished shape while allowing the use of metals that include better metallurgical properties. Casting often results in inferior grain structure within the metal, causing brittleness and thus catastrophic failure of the final cam member. The present teaching allows the use of stainless steel plate or sheet material. Plate and sheet material have been hot or cold rolled, causing work hardening and specifically oriented grain structure within the material for added strength and corrosion resistance. In addition, plate materials often include additives that improve machinability and weldability of the components used to construct the cam member.

Figure 2:
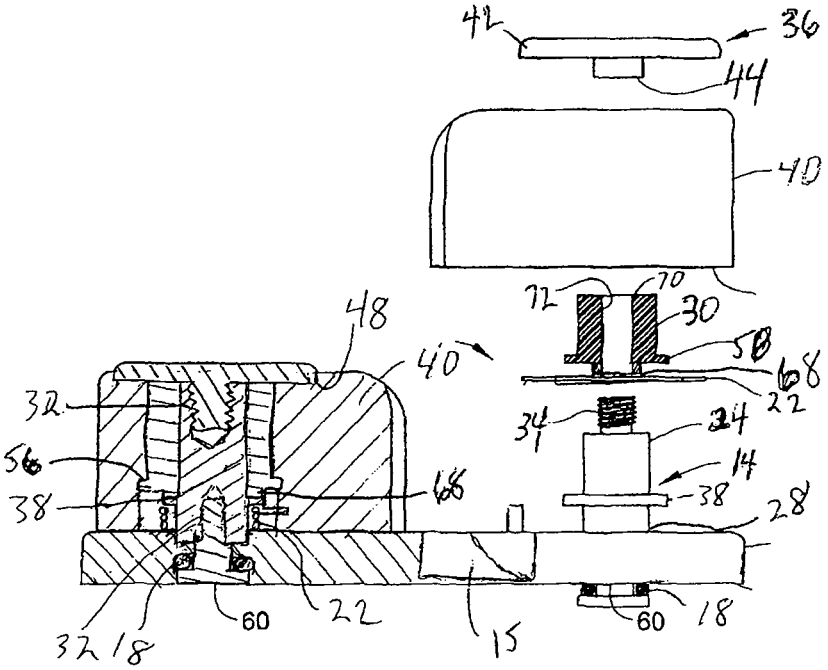
FIG. 2 is a partially sectioned and partially exploded side view of the cam cleat assembly illustrated in FIG. 1.
Figure 3:
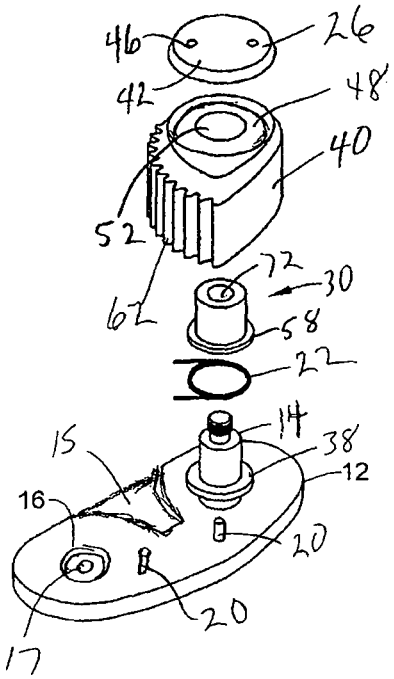
FIG. 3 is a partially exploded view of the cam cleat assembly illustrated in FIG. 1.

Still referring to FIGS. 6-9, the preferred embodiment of the stacked cam member includes a base plate 76, a first stack plate 78, a second stack plate 80 and a top plate 82. The base plate 76 is positioned at the bottom of the stack and includes a cylindrical bore 84 sized to cooperate with a cylindrical sleeve member 86 to align the stack of plates 76, 78, 80, and 82. The base plate 76 also includes a second cylindrical bore 88 sized to cooperate with pin member 90. In this manner, the area between the cylindrical bore 84 and cylindrical bore 88 can be removed for weight savings. The removed area also functions to cooperate with the stop pin 20 to control the swing distance that the cam member is allowed to travel through. Also included in the removed area is the spring pocket 92. The spring pocket 92 is positioned to cooperate with the spring 22 and the stop pin 20 to bias the cam member 40 to the closed position as illustrated in FIG. 2. The perimeter of the base plate 76 includes teeth 62 along the lobe surface 54 which are positioned to align with teeth on the next adjacent plate member.

The first stack plate 78 is positioned adjacent to the base plate 76 and the second stack plate 80, and includes a cylindrical bore 84 sized to cooperate with a cylindrical sleeve member 86 to align the stack of plates 76, 78, 80, and 82. The base plate also includes a second cylindrical bore 88 sized to cooperate with pin member 90. In this manner, the area between the cylindrical bore 84 and cylindrical bore 88 can be removed for weight savings. The second stack plate 80 is positioned adjacent to the first stack plate 78 and the top plate 82, and includes a cylindrical bore 84 sized to cooperate with a cylindrical sleeve member 86 to align the stack of plates 76, 78, 80, and 82. The base plate also includes a second cylindrical bore 88 sized to cooperate with pin member 90. In this manner, the area between the cylindrical bore 84 and cylindrical bore 88 can be removed for weight savings. The top plate 82 is positioned adjacent to the second stack plate 80 and includes a cylindrical bore 84 sized to cooperate with a cylindrical sleeve member 86 to align the stack of plates 76, 78, 80, and 82. The base plate also includes a second blind cylindrical bore 89 (FIG. 9) sized to cooperate with pin member 90. In operation, the plates 76, 78, 80, and 82 are aligned in a stacked arrangement, the sleeve 86 and pin 90 are positioned in their respective bores and welded 94 into place, thereby securing the assembly together. In an alternative embodiment, the sleeve 86 and pin 90 may be pressed or shrink-fit into place with an interference fit to secure the assembly together. It should be appreciated that the pin 90 and sleeve 86 prevent any single plate from movement with respect to the others in operation. It should also be appreciated that this construction of material, having superior grain structure, allows lighter part construction having the same strength and size of prior art cams, or allows a much more robust structure having the same size and weight providing a substantial advantage over known constructions.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A cam cleat comprising:

a base plate, said base plate including a top surface and a bottom surface said base plate including a pair of pockets sized to cooperate with a pair of spindle members for alignment, a spindle bolt aperture extending through each said pocket, said spindle bolt aperture sized and positioned so that a fastener may be extended upwardly through said base plate and into said spindle member;

said pair of spindle members being removably secured to said top surface of said base plate in a spaced apart arrangement, said pair of spindle members including a top end and a bottom end, said top end being cylindrical in shape for cooperation with a bearing member, said bearing member constructed from a solid non-metallic material, said bearing member being generally round in shape having a central bore, a radial flange and a lower flange, said central bore sized to cooperate with said top end of said spindle member, said radial flange cooperating with a shoulder within a respective cam member to prevent migration of said bearing member during loads, wherein a central portion of each said spindle member includes a flange, said spindle member flange positioned to cooperate with said lower flange of said bearing member to suspend a respective said cam member at a position above said top surface of said base plate during rotation of said cam member;

a pair of said cam members, each respective said cam member including an outer cam surface having a non-symmetrical lobe, an inner bore sized for cooperation with said bearing member;

a pair of top nuts, said top nuts secured to a top portion of each said spindle member to prevent said cam member from moving vertically along said spindle member.

2. The cam cleat of claim 1 wherein said base plate includes a smooth transitioning ramp surface that allows for increased angular interaction with a rope or line member, said ramp surface beginning at about a center of said top surface of said base plate and extending substantially to a bottom edge of a front surface of said base plate.

3. The cam cleat of claim 1 wherein each said fastener includes a seal positioned around each said fastener.

4. The cam cleat of claim 1 wherein said base plate includes a stop pin for each respective said cam member, each respective said stop pin positioned on said base plate to cooperate with a spring member, as well as a respective said cam member, to cause said spring member to bias said cam member to a base position, each respective said stop pin also positioned to prevent over rotation of a respective said cam member by engaging an internal stop surface.

5. The cam cleat of claim 1 wherein each respective said top nut includes an oversized head portion and a stem portion, said head portion including at least one internal driving surface for securing said top nut to a respective said spindle member.

6. The cam cleat of claim 1 wherein each respective said cam member is constructed from a stacked arrangement of thin plates, said stacked arrangement of plates being secured together to function as a monolithic cam member.

7. The cam cleat of claim 6 wherein said stacked arrangement includes a base stack plate, a first stack plate, a second stack plate and a top plate.

8. The cam cleat of claim 7 wherein base stack plate is positioned at the bottom of said stacked arrangement and includes a cylindrical bore sized to cooperate with a cylindrical sleeve member to align said first stack plate, said second stack plate and said top plate.

9. The cam cleat of claim 8 wherein said base stack plate includes a second cylindrical bore sized to cooperate with pin member.

* * * * *